US009895889B2

(12) United States Patent
Chen et al.

(10) Patent No.: US 9,895,889 B2
(45) Date of Patent: Feb. 20, 2018

(54) PRINTHEAD ASSEMBLY

(71) Applicant: HEWLETT-PACKARD DEVELOPMENT COMPANY, L.P., Houston, TX (US)

(72) Inventors: Chien-Hua Chen, Corvallis, OR (US); Jeremy Harlan Donaldson, Corvallis, OR (US); Teressa L. Roth, Brush Prairie, WA (US); Bradley B Branham, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/307,310

(22) PCT Filed: Jun. 23, 2014

(86) PCT No.: PCT/US2014/043661

§ 371 (c)(1),
(2) Date: Oct. 27, 2016

(87) PCT Pub. No.: WO2015/199642

PCT Pub. Date: Dec. 30, 2015

(65) Prior Publication Data

US 2017/0043582 A1 Feb. 16, 2017

(51) Int. Cl.

| | |
|---|---|
| ***B41J 2/14*** | (2006.01) |
| ***B41J 2/165*** | (2006.01) |
| ***B41J 2/155*** | (2006.01) |

(52) U.S. Cl.

CPC ..... *B41J 2/1433* (2013.01); *B41J 2/155* (2013.01); *B41J 2/16538* (2013.01); *B41J 2/16585* (2013.01); *B41J 2002/14491* (2013.01); *B41J 2002/16502* (2013.01)

(58) Field of Classification Search

CPC ..... B41J 2/1433; B41J 2/155; B41J 2/16538; B41J 2/16585

See application file for complete search history.

(56) References Cited

U.S. PATENT DOCUMENTS

| | | | |
|---|---|---|---|
| 4,935,755 | A | 6/1990 | Akutsu et al. |
| 5,095,322 | A | 3/1992 | Fletcher |
| 6,176,567 | B1 | 1/2001 | Uno et al. |
| 6,254,216 | B1 | 7/2001 | Arway et al. |
| 8,091,167 | B2 | 1/2012 | Teo et al. |

(Continued)

FOREIGN PATENT DOCUMENTS

| | | |
|---|---|---|
| CN | 1733493 | 2/2006 |
| CN | 102133817 | 7/2011 |

(Continued)

OTHER PUBLICATIONS

Wijshoff, Herman. The Dynamics of the piezo inkjet printhead operation.

*Primary Examiner* — Jason Uhlenhake
(74) *Attorney, Agent, or Firm* — HP Inc. Patent Department

(57) ABSTRACT

Examples of a printhead assembly are disclosed herein. An example of the printhead assembly includes a die to print, a base member, and at least one electrode. The electrode may be used to provide a charge to attract and collect particles that would normally otherwise interfere with operation of the die.

14 Claims, 5 Drawing Sheets

(56) References Cited

U.S. PATENT DOCUMENTS

| | | | | |
|---|---|---|---|---|
| 2001/0053501 | A1 | 12/2001 | Chen et al. | |
| 2003/0081078 | A1* | 5/2003 | Maeng | B41J 2/14137 347/65 |
| 2006/0092239 | A1 | 5/2006 | Sung et al. | |
| 2008/0018707 | A1 | 1/2008 | Masuyama et al. | |
| 2009/0066976 | A1 | 3/2009 | Uchida et al. | |
| 2013/0201237 | A1 | 8/2013 | Thomson et al. | |
| 2013/0215194 | A1* | 8/2013 | Leoni | B41J 2/1652 347/34 |

FOREIGN PATENT DOCUMENTS

| | | | |
|---|---|---|---|
| CN | 102145583 | | 8/2011 |
| CN | 102189770 | | 9/2011 |
| CN | 102574397 | | 7/2012 |
| JP | 63-114658 | A | 5/1988 |
| JP | 63-122544 | A | 5/1988 |
| JP | 2-178055 | | 7/1990 |
| JP | 2006-123550 | | 5/2006 |
| JP | 2008-155464 | | 7/2008 |
| JP | 2009-051039 | | 3/2009 |
| JP | 2011-194616 | | 10/2011 |
| JP | 2013-193390 | | 9/2013 |
| TW | 201124286 | A | 7/2011 |

* cited by examiner

PRINTHEAD ASSEMBLY

BACKGROUND

End users appreciate reliability and speed in their printing devices. They also appreciate quality output from printing devices, as well as cost-effective solutions for their printing needs. Designers and manufacturers may, therefore, endeavor to create and provide printing device components directed toward at least some of these objectives.

BRIEF DESCRIPTION OF THE DRAWINGS

The following detailed description references the drawings, wherein.

DETAILED DESCRIPTION

Figure 1:
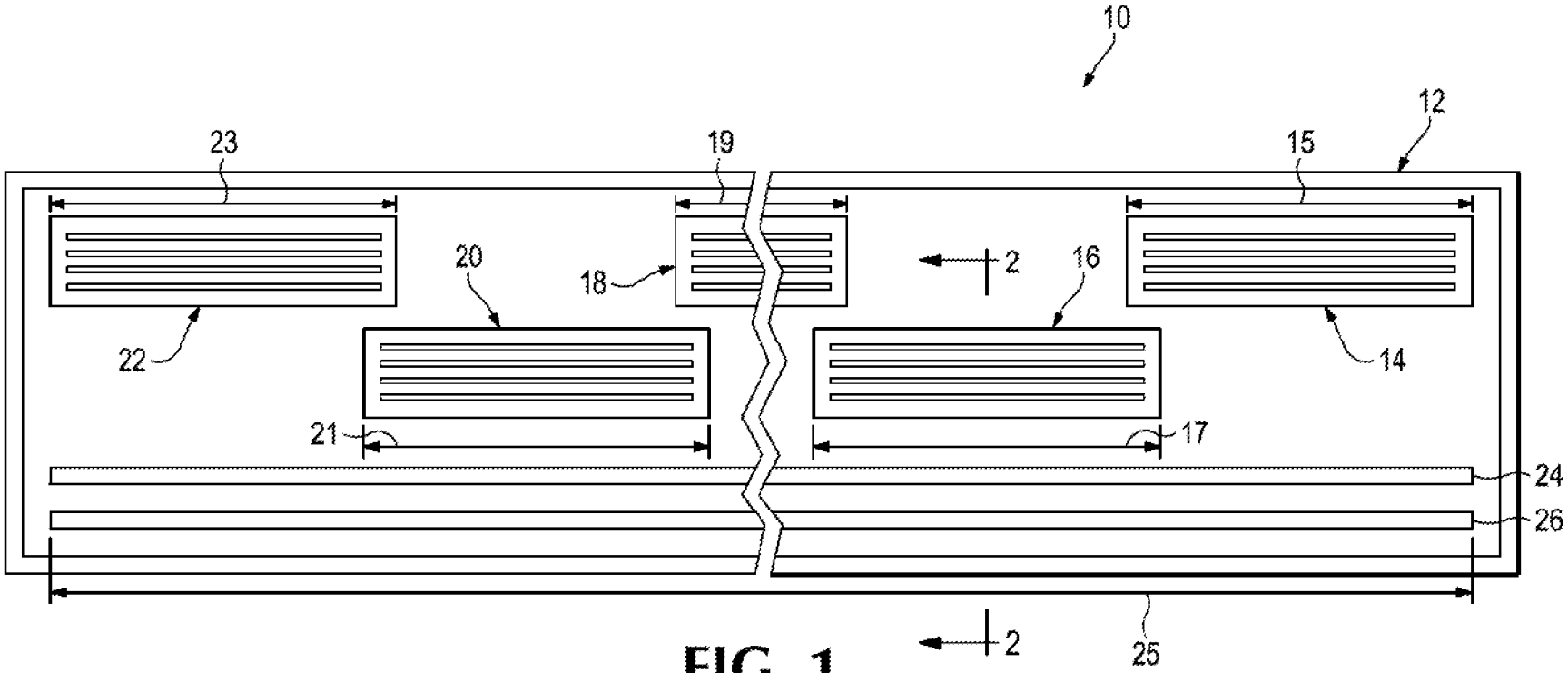
FIG. 1 is an example of a printhead assembly.

Printing devices deposit priming composition onto media. Printing devices may utilize at least one or more printheads to deposit the printing composition onto the media. Particles may collect on and/or be attracted to these one or more printheads. They also may be present in the printzone of a printing device. These particles can come from a variety of sources and places such as, for example, media fibers, dust, printing composition aerosol, hair, skin, fur and/or other debris.

Output print quality of a printing device degrades if these particles are allowed to collect on printheads. Such particles can be difficult to remove from these one or more printheads during servicing or maintenance thereof. This difficulty may arise, for example, due to electrostatic charge differences between the one or more printheads and these particles. Such ineffective servicing or maintenance of these one more printheads will result in a continuance of the degradation of the output print quality of a printing device causing end user dissatisfaction.

Output print quality degradation also results in wasted printing composition and media because print jobs need to be rerun which adds cost to the operation of printing devices. It also degrades printing device reliability and wastes end user time. Particle collection on the one or more printheads additionally increases the frequency of printhead servicing or maintenance which decreases print job speed of printing devices, resulting in additional end user dissatisfaction.

Examples directed to mitigating these challenges associated with particle collection on the one or more printheads of a printing device, as well as particles in the printzone of a printing device, are shown in FIGS. 1-8. These examples help to address the above-described issues caused by such particles, thereby helping to improve output print quality, lower the cost of use, increase print job speed, and maintain reliability of printing devices.

As used herein the term "printing device" represents a printer, plotter, press and/or device that uses any of the following Marking technologies or ft combination thereof: ink jet, dye sublimation, thermal transfer, 3D, laser, extrusion, off-set printing, or dot matrix. As used herein the terms "media" and "medium" are interchangeable and represent any type of paper or other printing medium (e.g., cloth, cardboard, canvas, transparency, substrate, etc.), having any type of finish on either or both sides (e.g., glossy, matte, plain, textured, etc.), in any size, shape, color, or form (e.g., sheet, roll (cut or uncut), folded, etc.) on which printing composition (e.g., ink, toner, colorant, wax, dye, powder, latex, printing fluid or solid, etc.) is placed, jetted, deposited, dropped, ejected, formed, or laid to create text or items (e.g., text, images, graphics, pictures, formulas, charts, two-dimensional objects, three-dimensional objects, etc.).

As used herein, the terms "head" and "printheads" represent a mechanism or device that implements any of the above-described marking technologies. A print head or print heads can be a single device or mechanism, or arranged in a module or array such as, for example, a print bar or page-wide array. As used herein, the term "printzone" represents the area, location or portion of a printing device where a printhead or printheads utilize printing composition to create images and/or items on a medium.

An example of a printhead assembly 10 is shown in FIG. 1. As can be seen in FIG. 1, printhead assembly 10 includes a base member 12 and a plurality of dies 14, 16, 18, 20, and 22 to print. As can also be seen in FIG. 1, printhead assembly 10 additionally includes an electrode 24 to provide a charge (e.g., positive) to attract and collect particles of a polarity (e.g., negative). As can also be seen in FIG. 1, printhead assembly 10 may also include an additional electrode 26 to provide a charge (e.g., negative) attract and collect particles of a polarity (e.g., positive). Base member 12 is coupled to dies 14, 16, 18, 20, and 22 and electrodes 24 and 26 to provide support to them. Base member 12 is also electrically connected to each of dies 14, 16, 18, 20, and 22 and electrodes 24 and 26, as discussed more fully below.

As can additionally be seen in FIG. 1, electrodes 24 and 26 of printhead assembly 10 are continuous structures extending along a length 25 of base 12. As can further be seen in FIG. 1, each of dies 14, 16, 18, 20, and 22 includes a respective longitudinal axis 15, 17, 19, 21, and 23 and both electrodes 24 and 26 are substantially parallel to longitudinal axes 15, 17, 19, 21, and 23. In other examples of printhead assembly 10, electrode 24 and/or electrode 26 may be discontinuous structures. Additionally or alternatively, in other examples of printhead assembly 10, electrode 24 and/or electrode 26 may be other than substantially parallel to longitudinal axes 15, 17, 19, 21, and 23 of respective dies 14, 16, 18, 20, and 22. For example, electrode 24 and/or electrode 26 may be substantially perpendicular to one or more of longitudinal axes 15, 17, 19, 21, and 23 of respective dies 14, 16, 18, 20, and 22. As another example, electrode 24 and/or electrode 26 may encircle at least a portion of one or more of dies 14, 16, 18, 70, and 22.

Figure 2:
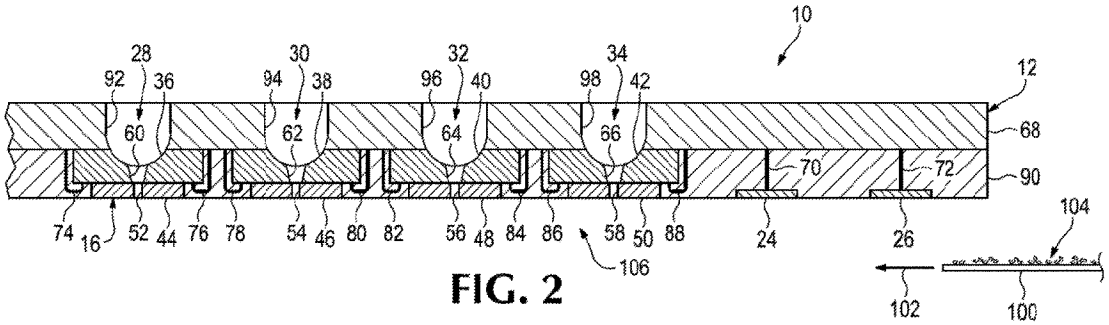
FIG. 2 is an example of a cross-sectional view of the printhead assembly of FIG. 1 taken along line 2-2 of FIG. 1.

An example of a cross-sectional view of printhead assembly 10 taken along line 2-2 of FIG. 1 is shown in FIG. 2. As can be seen in FIG. 2, in this example, die 16 of print head assembly 10 includes slivers 28, 30, 32, and 34 coupled to base 12. Each of slivers 28, 30, 32 and 34 typically includes an integrated circuit formed on respective substrates 36, 38, 40, and 42. Each of slivers 28, 30, 32, and 34 also include a respective chamber layer and a nozzle plate 44, 46, 48, and 50 which are shown as single structures, for purposes of illustration, and may actually each include multilayer structures.

As can also be seen in FIG. 2, each of slivers 28, 30, 32, and 34 additionally include respective nozzles 52, 54, 56, and 58, coupled to respective flow passages 60, 62, 64, and 66, through which printing composition is ejected, as discussed more fully below. Although a single nozzle 52, 54, 56, and 58 is illustrated for each of slivers 28, 30, 32, and 34, it is to be understood that in other examples of printhead assembly 10, slivers 28, 30, 32 and/or 34 may include additional nozzles and/or flow passages 60, 62, 64, and 66 through which the same color or different colors of printing composition are ejected. Additionally, although not shown, it is to be understood that in other examples of printhead assembly 10, die 16 may include fewer (e.g., one) or more slivers with one or plurality of nozzles and/or flow passages.

As can additionally be seen in FIG. 2, base member 12 includes a printed circuit board 68 coupled and electrically connected to die 16 and electrodes 24 and 26. In this example of printhead assembly 10, electrodes 24 and 26 are connected to printed circuit board 68 by respective conductors 70 and 72, and each of slivers 28, 30, 32, and 34 of die 16 are connected to printed circuit board 68 by respective pairs of conductors 74 and 76, 78 and 80, 82 and 84, and 86 and 88. Although not shown, it is to be understood that in other examples of printhead assembly 10, more than one conductor may be used to connect printed circuit board 68 to electrodes 24 and 26 and fewer or more conductors may be used to connect printed circuit board 68 to each of slivers 28, 30, 32, and 34.

As can thither be seen in FIG. 2, printhead assembly 10 also includes a printing composition channel 92, 94, 96, and 98 in printed circuit board 68 of base member 12 adjacent respective slivers 28, 30, 32, and 34 of die 16. In this example, printing composition channels 92, 94, 96, and 98 extend to a portion of each of respective substrates 36, 38, 40, and 42. Printing composition channels 92, 94, 96, and 98 are coupled to respective flow passages 60, 62, 64, and 66 of slivers 28, 30, 32, and 34 to supply printing composition thereto. Although not shown, it is to be understood that in other examples of printhead assembly 10, fewer (e.g. one) or more printing composition channels may be utilized.

As can still further be seen in FIG. 2, base member 12 also includes a molding 90 over at least a portion of electrodes 24 and 26, slivers 28, 30, 32, and 34 of die 16, and printed circuit board 68. Molding 90 helps to protect electrodes 24 and 26, slivers 28, 30, 32, and 34 of die 16, and printed circuit board 68, as well as to support and couple them together. Although not shown, it is to be understood that in other examples of printhead assembly 10, molding 90 may not be over at least a portion of electrodes 24 and 26, slivers 28, 30, 32 and 34 of die 16 and/or printed circuit board 68.

As can yet further be seen in FIG. 2, a medium 100 is traveling under and toward printhead assembly 10, as generally indicated by arrow 102. Medium 100 includes particles 104 on medium 100 which are undesirable for at least the reasons discussed above. Although not shown, particles 104 may also be present around printhead assembly 10 in printzone 106. Additionally, although not shown, it is to be understood that the above-described and following description and illustration of die 16 applies as well to dies 14, 18, 20 and 22.

Figure 3:
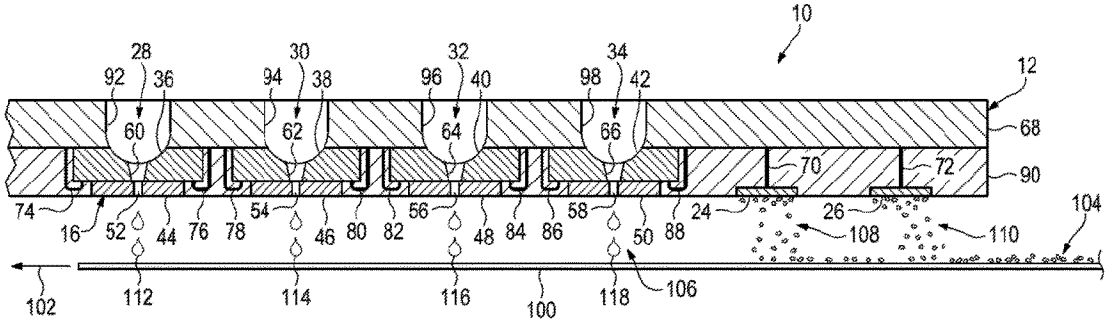
FIG. 3 is an example of the printhead assembly of FIG. 2 illustrating the attraction and collection of particles.
Figure 4:
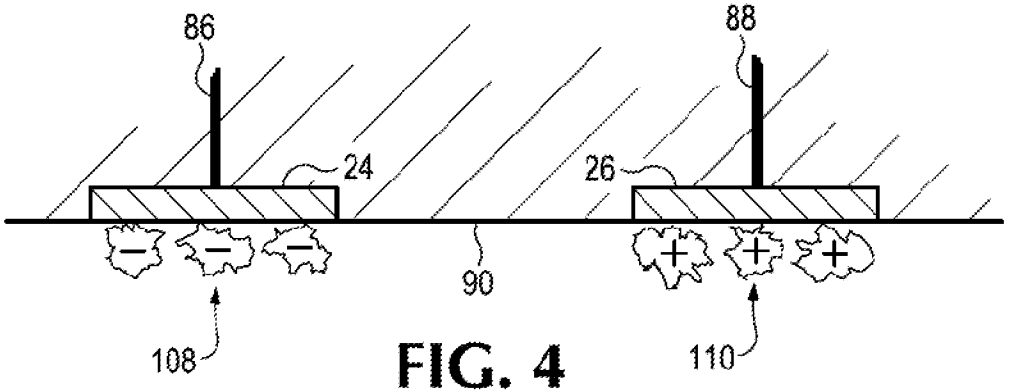
FIG. 4 is an example of an enlarged view of the attraction and collection of particles of a negative polarity and attract on and collection of particles of a positive polarity.

An example of printhead assembly 10 illustrating the attraction and collection of particles 104 on medium 100 is shown in FIG. 3. As can be seen in FIG. 3, in this example, particles 104 include both particles of a negative polarity 108 that are attracted and collected by electrode 24 and particles of a positive polarity 110 that are attracted and collected by electrode 26. FIG. 4 is an example of an enlarged view of this attraction and collection of particles of a negative polarity 108 by electrode 24 and this attraction and collection of particles of a positive polarity 110 by electrode 26.

Referring again to FIG. 3, particles 104 on medium 100, as well as those in and adjacent to printzone 106, are attracted and collected by electrodes 24 and 26 prior to the ejection of printing composition 112, 114, 116, and 118 onto medium 100 by respective nozzles 52, 54, 56, and 58. This helps to maintain print quality of printhead assembly 10 which could be otherwise be degraded by particles 104. As can also be seen in FIG. 3, in this example, printing composition 112 is cyan, printing composition 114 is magenta, printing composition 116 is yellow, and printing composition 118 is black. Although not shown, it is to be understood, however, that other examples of printhead assembly 10 may utilize one or more different colors of printing composition. Alternatively, printing composition 112, 114, 116, and 118 may all be of the same color.

Figure 5:
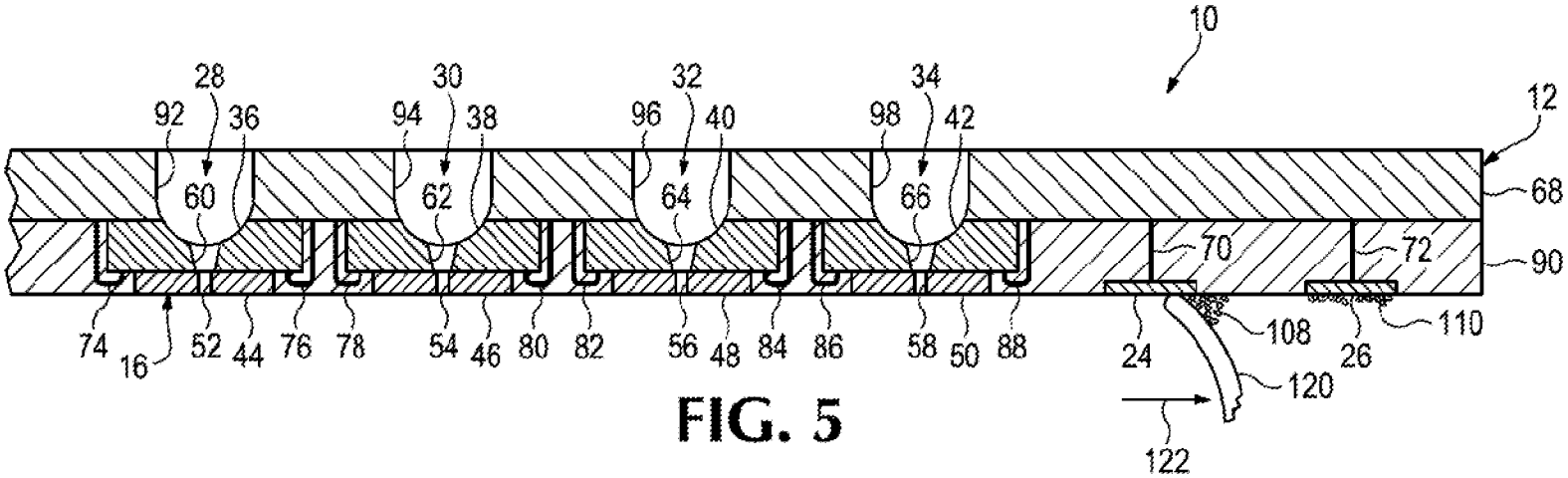
FIG. 5 is an example of the printhead assembly of FIG. 3 illustrating servicing thereof.

An example of printhead assembly 10 illustrating servicing thereof is shown in FIG. 5. As can be seen in FIG. 5, electrode 24 may be connected to base member 12 to provide a negative charge to repel previously collected particles 108 of a negative polarity during servicing of die 16 by wiper 120, as generally indicated by arrow 122, which removes particles 108 from electrode 24. As can also be seen in FIG. 5, electrode 26 may be connected to base member 12 to provide a positive charge to repel previously collected particles 110 of a positive polarity during servicing of die 16 by wiper 120 which removes particles 110 from electrode 26. Although a wiper 120 is shown servicing die 16 and removing particles 105 and 110 from respective electrodes 24 and 26 in FIG. 5, it is to be understood that in other examples of printhead assembly 10, different structures or techniques may be utilized to service die 16 and/or remove particles 108 and 110 from respective electrodes 24 and 26.

Figure 6:
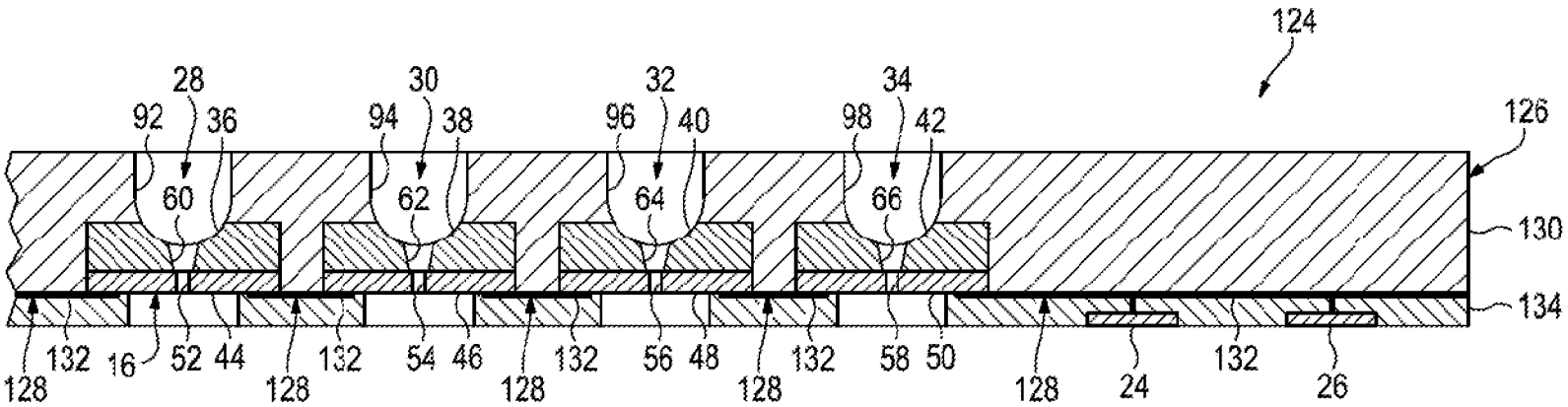
FIG. 6 is another example of a printhead assembly.

An example of another printhead assembly 124 is shown in FIG. 6. Where possible, the same reference numerals have been used for the elements of printhead assembly 124 that are the same as the elements of printhead assembly 10. As can be seen in FIG. 6, base member 126 of printhead assembly 124 includes an electrical redistribution layer 128 connected to electrodes 24 and 26, as well as each of slivers 28, 30, 32, and 34 of die 16. Base member 126 also includes a molding 130 over at least a portion of slivers 28, 30, 32, and 34 of die 16 to help protect slivers 28, 30, 32, and 34 of die 16, as well as to support and couple them together.

As can also be seen in FIG. 6, printhead assembly 10 additionally includes a printing composition channel 92, 944, 96, and 988 in molding 130 of base member 126 adjacent respective slivers 28, 30, 32, and 34 of die 16. In this example, printing composition channels 92, 94, 96, and 98 extend to a portion of each of respective substrates 36, 38, 40, and 42. Printing composition channels 92, 94, 96, and 98 are coupled to respective flow passages 60, 62, 64, and 66 of slivers 28, 30, 32, and 34 to supply printing composition thereto. Although not shown, it is to be understood that in other examples of printhead assembly 124, fewer (e.g. one) or more printing composition channels may be utilized.

As can additionally be seen in FIG. 6, redistribution layer 128 also includes metal traces 132 and a dielectric layer 134 over at least a portion of slivers 28, 30, 32, and 34 of die 16 and molding 130 to help protect slivers 28, 30, 32, and 34 of die 16 and molding 130. Although not shown, it is to be understood that in other examples of printhead assembly 124, dielectric layer 134 may not be over at least a portion of slivers 28, 30, 32, and 34 of die 16 and/or molding 130. Additionally, it is to be understood that the above-described example of servicing of printhead assembly 10 shown in FIG. 5 is also applicable to servicing of printhead assembly 124.

Figure 7:
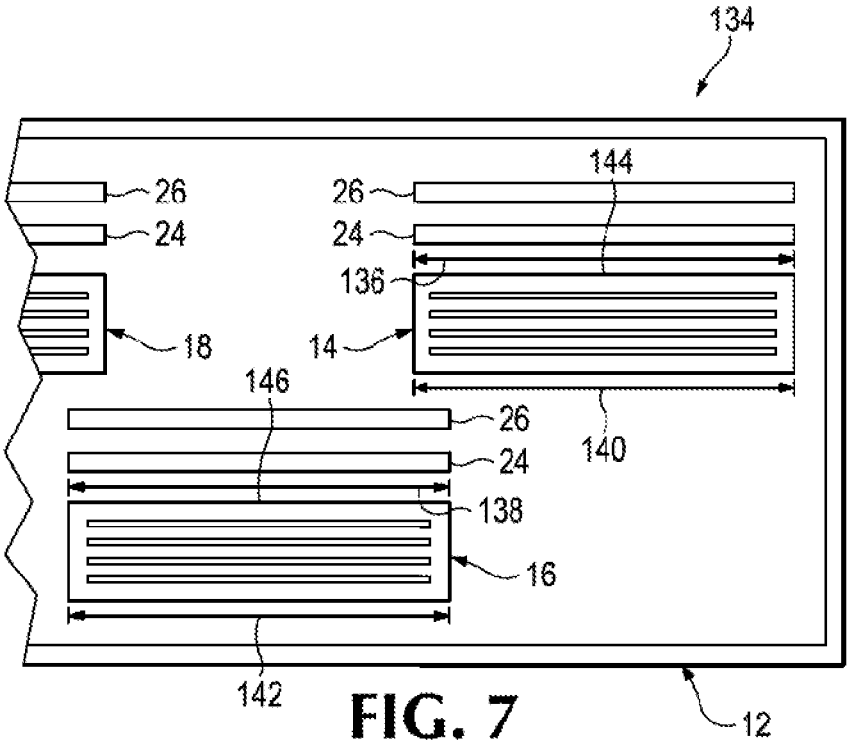
FIG. 7 is an additional example of a portion of a printhead assembly.

An additional example of a portion of a printhead assembly 134 is shown in FIG. 7. Where possible, the same reference numerals have been used for the elements of printhead assembly 134 that are the same as the elements of printhead assembly 10. As can be seen in FIG. 7, electrodes 24 and 26 of printhead assembly 134 are discontinuous structures extending along lengths 136 and 138 of respective dies 14 and 16. As can also be seen in FIG. 7, each of dies 14 and 16 includes a respective longitudinal axis 140 and 142 and both electrodes 24 and 26 are substantially parallel to longitudinal axes 140 and 142. As can additionally be seen in FIG. 7, each of dies 14 and 16 includes a respective side 144 and 146 and both electrodes 24 and 26 are located adjacent sides 144 and 146.

It is to be understood that the above-described example of servicing of printhead assembly 10 shown in FIG. 5 is also applicable to servicing of printhead assembly 134. In other examples of printhead assembly 134, electrode 24 and/or electrode 26 may be continuous structures. Additionally or alternatively, in other examples of printhead assembly 134, electrode 24 and/or electrode 26 may be other than substantially parallel to longitudinal axes 140 and 142 of respective dies 14 and 16. For example, electrode 24 and/or electrode 26 may be substantially perpendicular to one or more of longitudinal axes 140 and 142 of respective dies 14 and 16. As another example, electrode 24 and/or electrode 26 may encircle at least a portion of one or more of dies 14 and 16.

Figure 8:
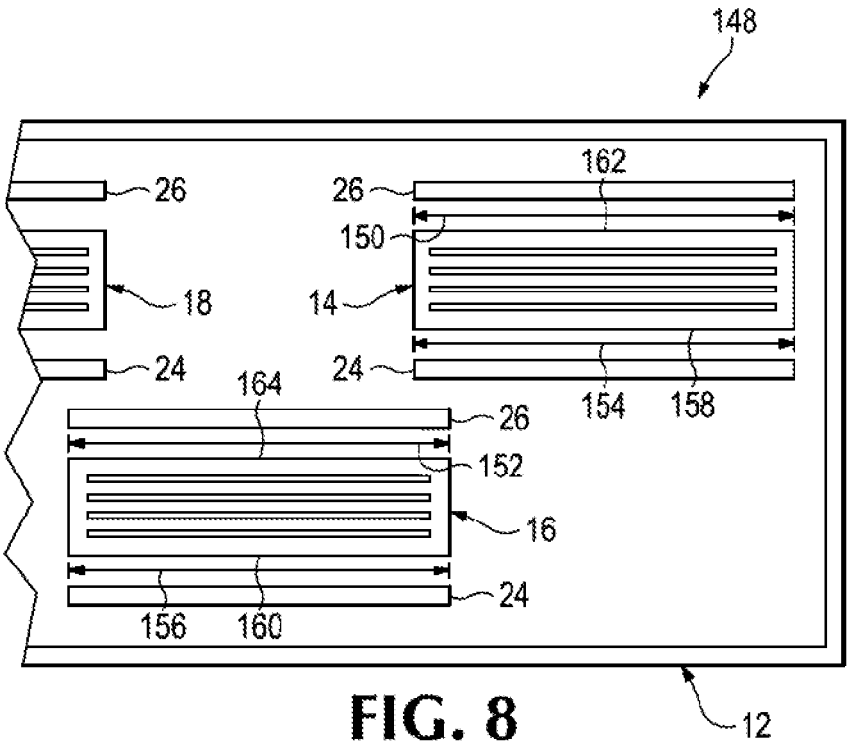
FIG. 8 is a further example of a portion of a printhead assembly.

A further example of a portion of a printhead assembly 148 is shown in FIG. 8. Where possible, the same reference numerals have been used for the elements of printhead assembly 148 that are the same as the elements of printhead assembly 10. As can be seen in FIG. 8, electrodes 24 and 26 of printhead assembly 148 are discontinuous structures extending along lengths 150 and 152 of respective dies 14 and 16. As can also be seen in FIG. 8, each of dies 14 and 16 includes a respective longitudinal axis 154 and 156 and both electrodes 24 and 26 are substantially parallel to longitudinal axes 154 and 156. As can additionally be seen in FIG. 8, each of dies 14 and 16 includes a respective side 158 and 160 and electrodes 24 are located adjacent sides 158 and 160. As can further be seen in FIG. 8, each of dies 14 and 16 includes a respective side 162 and 164 and electrodes 26 are located adjacent sides 162 and 164.

It is to be understood that the above-described example of servicing of printhead assembly 10 shown in FIG. 5 is also applicable to servicing of printhead assembly 148. In other examples of printhead assembly 148, electrode 24 and/or electrode 26 may be continuous structures. Additionally or alternatively, in other examples of printhead assembly 148, electrode 24 and/or electrode 26 may be other than substantially parallel to longitudinal axes 154 and 156 of respective dies 14 and 16. For example, electrode 24 and/or electrode 26 may be substantially perpendicular to one or more of longitudinal axes 154 and 156 of respective dies 14 and 16. As another example, electrode 24 and/or electrode 26 may encircle at least a portion of one or more of dies 14 and 16

Although several drawings have been described and illustrated in detail, it is to be understood that the same are intended by way of illustration and example. These examples are not intended to be exhaustive or to be limited to the precise form disclosed. Modifications and variations may well be apparent. For example, electrodes 24 and 26 may be located in positions other than on base member 12 (e.g., substrates 36, 38, 40, and 42 or chamber layer and nozzle plates 44, 46, 48, and 50). As another example, printhead assemblies 10, 124, 134 and/or 148 may utilize a single electrode or more than two electrodes. As a further example, printhead assemblies 10, 124, 134 and/or 148 may include a single die. As yet a further example, electrodes 24 and 26 may be utilized for additional purposes such as die warming, determining printhead to media spacing, and reducing printing composition puddling.

Additionally, reference to an element in the singular is not intended to mean one, unless explicitly so stated, but rather means at least one. Furthermore, unless specifically stated, any method elements are not limited to the sequence or order described and illustrated. Moreover, no element or component is intended to be dedicated to the public regardless of whether the element or component is explicitly recited in the following claims.

What is claimed is:

1. A printhead assembly, comprising:
- a die to print;
- a first electrode to provide a positive charge to attract and collect particles of a negative polarity;
- a second electrode to provide a negative charge to attract and collect particles of a positive polarity; and
- a base member to support and electrically connect to the die.

2. The printhead assembly of claim 1, wherein the base member includes a printed circuit board coupled and electrically connected to the die, the first electrode, and the second electrode.

3. The printhead assembly of claim 1, wherein the base member includes an electrical redistribution layer connected to the die, the first electrode, and the second electrode, and further wherein the electrical redistribution layer includes a dielectric layer over at least a portion of the die, the first electrode, and the second electrode.

4. The printhead assembly of claim 1, wherein the die includes a longitudinal axis and at least one of the first electrode is substantially parallel to the longitudinal axis of the die and the second electrode is substantially parallel to the longitudinal axis of the die.

5. The printhead assembly of claim 1, wherein the first electrode and the second electrode are located on a same side of the die.

6. The printhead assembly of claim 1, wherein the first electrode is located on a first side of the die and the second electrode is located on a second side of the die.

7. The printhead assembly of claim 1, wherein the first electrode is connected to the base member to provide a negative charge to repel previously collected particles of a negative polarity during servicing of the die and the second electrode is connected to the base member to provide a positive charge to repel previously collected particles of a positive polarity during servicing of the die.

8. A printhead assembly, comprising:
- a base member;
- a plurality of dies coupled and electrically connected to the base member;
- a printing composition channel in the base member and adjacent to each of the dies; and
- an electrode coupled and electrically connected to the base member, adjacent each of the dies, to provide a charge, wherein the base member includes an electrical redistribution layer connected to each of the dies and the electrode, and further wherein the electrical redistribution layer includes a dielectric layer over at least a portion of each of the dies, and the electrode.

9. The printhead assembly of claim 8, wherein the base member includes a printed circuit board coupled and electrically connected to each of the dies and the electrode.

10. The printhead assembly of claim 8, wherein each die includes a longitudinal axis and the electrode is substantially parallel to the longitudinal axes of the dies.

11. The printhead assembly of claim 8, further comprising an additional electrode coupled and electrically connected to the base member and adjacent each of the dies to provide an opposite charge.

12. The printhead assembly of claim 11, wherein each die includes a longitudinal axis and the additional electrode is substantially parallel to the longitudinal axes of the dies.

13. The printhead assembly of claim 11, wherein the electrodes are located on a same side of each of the dies.

14. The printhead assembly of claim 11, wherein the electrodes are located on opposite sides of each of the dies.

* * * * *